US007185405B2

(12) United States Patent
Rastogi et al.

(10) Patent No.: US 7,185,405 B2
(45) Date of Patent: Mar. 6, 2007

(54) PROCESS FOR THE PREPARATION OF INDIGO DYED YARN FOR USE IN THE MANUFACTURE OF KNITTED FABRIC

(75) Inventors: B. L. Rastogi, Punjab (IN); Jangi Lal Oswal, Punjab (IN)

(73) Assignee: Malwa Cotton Spinning Mills Ltd., Punjab (IN)

( * ) Notice: Subject to any disclaimer, the term of this patent is extended or adjusted under 35 U.S.C. 154(b) by 0 days.

(21) Appl. No.: 10/493,924

(22) PCT Filed: Oct. 31, 2001

(86) PCT No.: PCT/IN01/00195

§ 371 (c)(1),
(2), (4) Date: Apr. 27, 2004

(87) PCT Pub. No.: WO03/038176

PCT Pub. Date: May 8, 2003

(65) Prior Publication Data

US 2004/0250391 A1 Dec. 16, 2004

(51) Int. Cl.
*B65H 54/00* (2006.01)

(52) U.S. Cl. ..... 28/190; 66/202

(58) Field of Classification Search ..... 66/202, 66/169 R–171; 242/418.1, 420.6; 28/172.1, 28/190–202
See application file for complete search history.

(56) References Cited

U.S. PATENT DOCUMENTS

| | | | | |
|---|---|---|---|---|
| 4,316,370 | A * | 2/1982 | Steiner | 68/5 D |
| 4,613,336 | A * | 9/1986 | Quinnen | 8/494 |
| 5,035,369 | A * | 7/1991 | Beran et al. | 242/486.1 |
| 6,199,787 | B1 * | 3/2001 | Jaffar et al. | 242/418.1 |

FOREIGN PATENT DOCUMENTS

| | | | | |
|---|---|---|---|---|
| EP | 0202197 | | 2/1982 | |
| GB | 2401118 | A1 * | 11/2004 | 66/202 |

* cited by examiner

*Primary Examiner*—Danny Worrell
(74) *Attorney, Agent, or Firm*—The Webb Law Firm

(57) ABSTRACT

A process for the preparation of indigo dyed yarn for use in the manufacture of knitted fabric by a knitting machine comprising in the steps of, forming a dyed rope of yarn by the steps of indigo dyeing; individualizing the yarn of said dyed rope; forming separate packages of the yarn on separate spools of fixed ends; preparing individual hanks of each yarn end of each spool by hank maker; converting said hanks into individual cones of single yarn.

10 Claims, 2 Drawing Sheets

PROCESS FOR THE PREPARATION OF INDIGO DYED YARN FOR USE IN THE MANUFACTURE OF KNITTED FABRIC

FIELD OF THE INVENTION

This invention relates to a novel process for the preparation of indigo dyed yarn for use in the manufacture of knitted fabric.

PRIOR ART

The process of indigo dyeing is known as such in the art. In the known process, the dyeing of yarn is continuous only on the surface because of oxidation during the process. In such a process, the core of the yarn remains undyed and is always in its natural shade. Such a process of indigo dyeing is performed at room temperature and under atmospheric pressure. The yarn is dyed in the form of a rope containing 240–400 ends throughout its length and is dyed by using a rope dyeing machine. For this purpose, the rope is first subjected to the process of scouring at a temperature of 75 to 85° C. and then subjected to the successive steps of hot and cold wash. The washed yarn is then passed through a plurality of dye baths, the number of dye baths being dependent on the colour and the shade. Finally, the yarn is subjected to the step of hot washing at 60–70° C. followed by cold wash at room temperature and then to the step of softening. As will be apparent, the process employs an open bath system and yarn is subjected to air oxidation, which is required for surface dyeing of the yarn. The rope with 240–400 ends and which is subjected to such a step of dyeing is prepared by a warping machine. The dyed rope obtained after the process of dyeing is delivered into a can capable of accommodating upto 100 kgs. of rope.

The dyed rope with the required ends is then fed to a long chain beamer to convert the rope into a warper beam and then subjected to the step of sizing to impart strength so as to withstand friction during weaving of cloth on a loom. However, prior to the step of sizing, each end of yarn is individualized and then wound onto a beam widthwise.

The process described hereinabove was advantageously employed in the weaving of a fabric in a loom, but could not be employed in a knitting machine for producing a knitted fabric.

OBJECTS OF THE INVENTION

A primary object of this invention is to propose a process for the preparation of indigo dyed yarn for use in the manufacture of knitted fabrics.

Another object of this invention is to propose a process for the preparation of indigo dyed yarn in the form of cone where the yarn is received in fixed numbers of ends from the dyed rope of 216 ends. On 6 individuals spools fitted on the shaft and thus avoiding the use of Warper Beam.

Yet another object of this invention is to propose a process for the preparation of indigo dyed yarn in the form of cone for use in the manufacture of knitted fabric as intermediate or individual spool used for shifting the yarn from Warper Beam, cannot be fed directly to knitting machines to knit the fabric and thus avoiding use of intermediate spools and individuals spools.

A further object of this invention is to propose a system for preparation of dyed indigo yarn for manufacture of knitted fabrics. So far the process in existence was suitable for weaving i.e. for manufacturing cloth only. Reason is that yarn used to be received on Warper Beamer having 3600 ends to 4000 ends cannot be used on a knitting machine.

FIELD OF THE INVENTION

According to this invention, there is provided a process for the preparation of indigo dyed yarn for use in the manufacture of knitted fabric comprising receiving a dyed yarn from a dyed rope, individualizing the yarns forming said rope, receiving a sheet of said yarns on its respective spool and such that the yarns from said rope are collected as a plurality of individual length of yarn on its respective spool, preparing individual hanks from the respective individual ends of yarn of the spool, converting said hank into a cone of single yarn by hank to cone maker.

The process for the preparation of indigo dyed yarn according to a preferred embodiment of this invention is herein described in detail in the following description.

In accordance with the present invention, a dyed rope is prepared in a manner known as such in the art. In the known process, the dyed rope is fed to a long chain beamer to form a warper beam.

Such a warper beam could be employed only in the process of weaving a fabric and not for producing a knitted fabric.

In distinction to the known art, the dyed yarn from a dyed rope is received directly on a plurality of spools, such as a set of six spools, instead of a warper beam in the conventional process. The spools are mounted on a warper beam shaft driven by a friction drum which is driven by a motor independently. Each spool receives, for example, 36 ends through warper comb and separator. The machine has a rope vibrator to open the rope into individual yarn and a stop motion device so as to stop the machine in the event of a missing or broken yarn. Six spools of 36 ends are produced at a time with, for example, 12–13 kgs. of weight of yarn in each spool. The spools are mounted on a tripod with bearings and shaft to feed a hank making machine to prepare individual hank from individual end of the spool. The spool is self-driven with the yarn tension inserted by yarn process while making hank on swift of reeling machine. In total, 36 hanks are produced in the example referred to hereinabove. This machine is equipped with yarn separators to avoid entanglement of yarn and is driven by motor. The hank is mounted individually on individual hank holder of hank to cone winding machine to convert hank into cone of single yarn. These machines have stop motions for hank as well as for cone for end breakage and works instantly. Each cone is driven individually through a friction roller driven by motor. In the present invention receiving the material (yarn) directly on 6 spools in place of warper beam constitutes an aspect of invention and, wherein a cone package of single yarn is converted from dyed rope of 216 ends.

DESCRIPTION WITH REFERENCE TO DRAWINGS

Further objects and advantages of this invention will be more apparent from the ensuing description and wherein FIG. 1 shows the machine for formation of yarn into separate spools on a long chain beamer;

As described, a dyed rope of, for example, 222 ends is dyed in a manner known in the art with respect to indigo dyeing of yarn for weaving of a cloth in a loom. However, in the instance of weaving of cloth in a loom, the yarns of the dyed rope are individualized and then wound widthwise on a single beam, such steps being effected in a long chain beamer.

Figure 1:
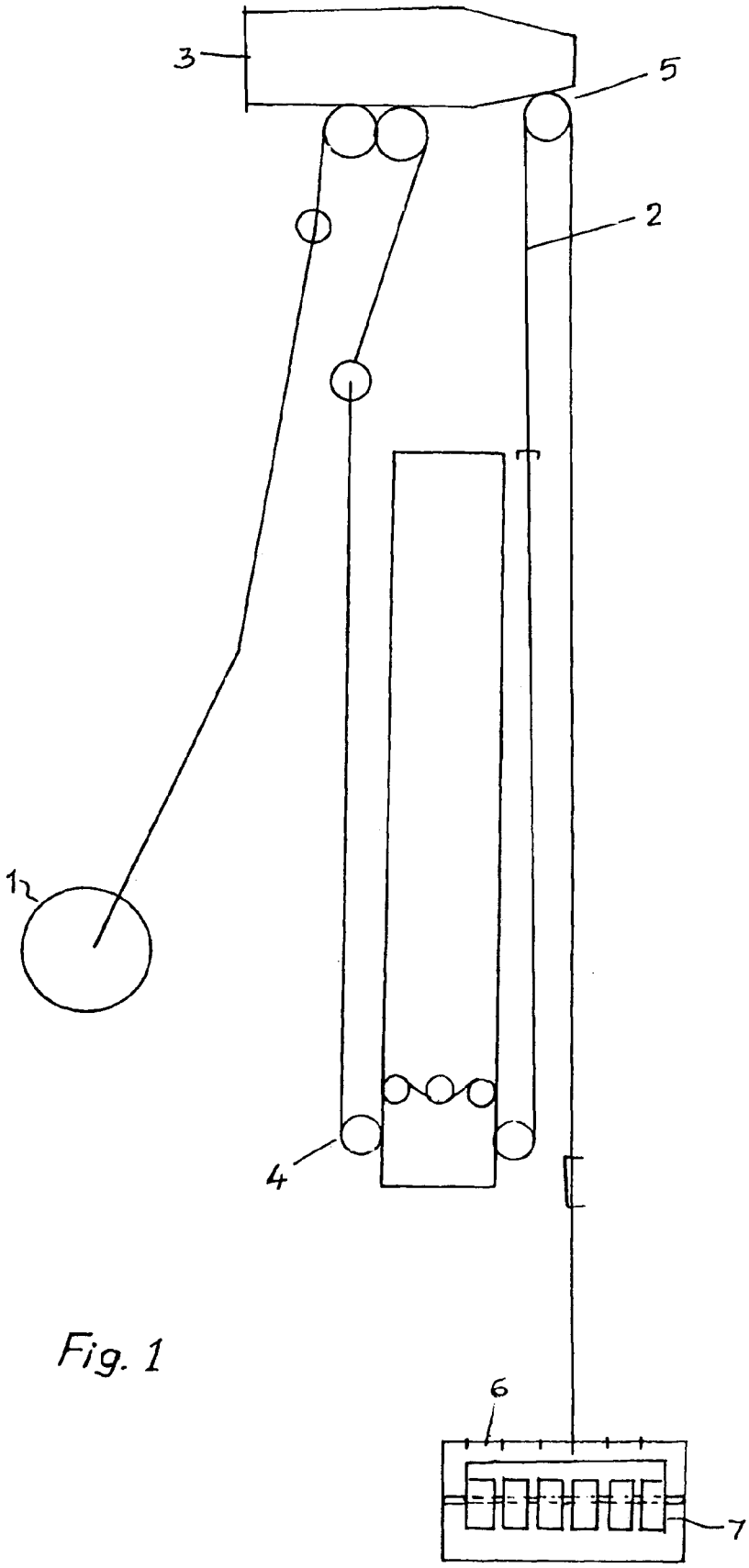

Though a long chain beamer (LCD) of FIG. 1 is also employed in the present invention, the yarns are no longer wound widthwise on a single beam. Instead, and if the dyed rope consists of, for example, 222 ends, the yarns are divided onto 6 separate beams or spools having 37 ends. Each spool has preferably the same number of yarns. Thus, the package of dyed rope of 222 ends is divided into 6 separate packages of 37 ends. For this purpose, the dyed rope or package 2 ends, for example, of 222 yarn ends from card. Can 1 is fed to a tension stand 3 and then guided over guide pulleys 4 into an accumulator 5. The rope 2 travels into a head stock assembly 6 and finally wound onto aluminium spools 7 through separators 8. Though not shown in the drawings, such long chain beamer LCD has a vibrator to cause an individualization of the yarns and a stop motion device to stop the device in the event of a breakage of yarn.

Figure 2:
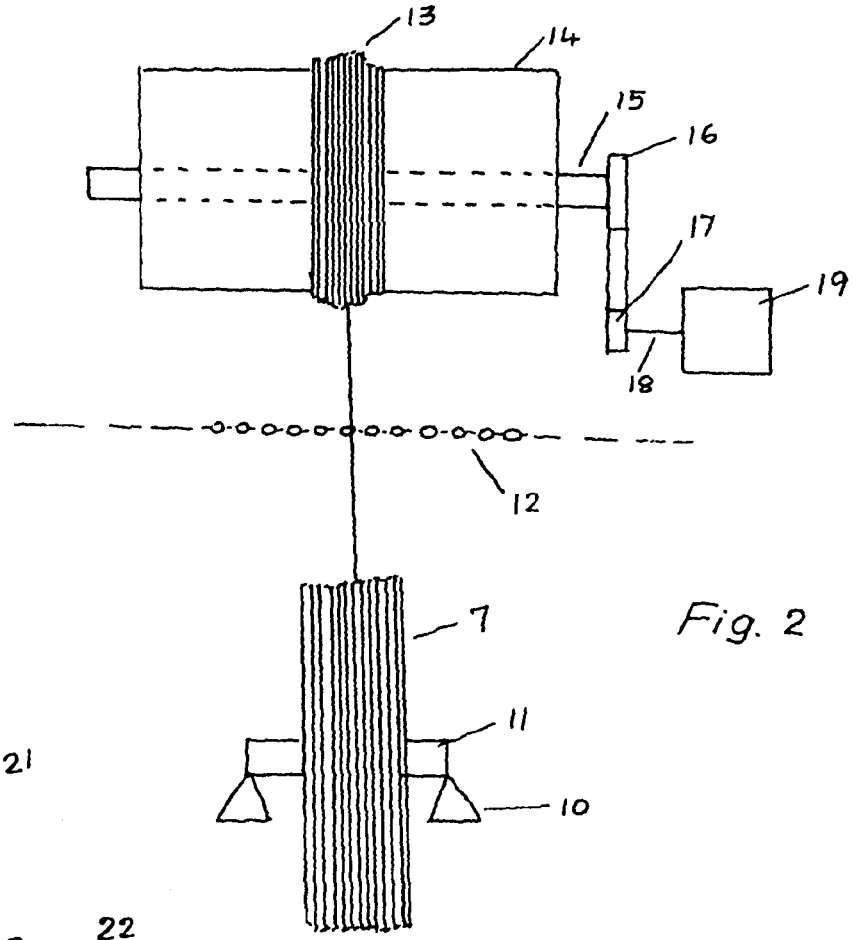
FIG. 2 shows the machine for formation of the hanks.

Each spool 7 is mounted on a tripod 9 (see FIG. 2) to feed to a hank maker machine to prepare individual hank from individual yarn end of a spool. The hank maker machine of FIG. 2 comprises a tripod 10 for rotatably holding a shaft 11 on which spool 7 is mounted. The ends pass through a heald 12 and a stop motion device (not shown) to stop the machine in the presence of a broken end of yarn. A hank 13 is wound on hank maker 14 mounted on a shaft 15. Shaft 15 has a pulley 16 adapted to be driven by a pulley 17 mounted on drive shaft 18 of a motor 19. If each spool 7 has 37 ends, 37 hanks are formed by the reeling machine of FIG. 2.

Figure 3:
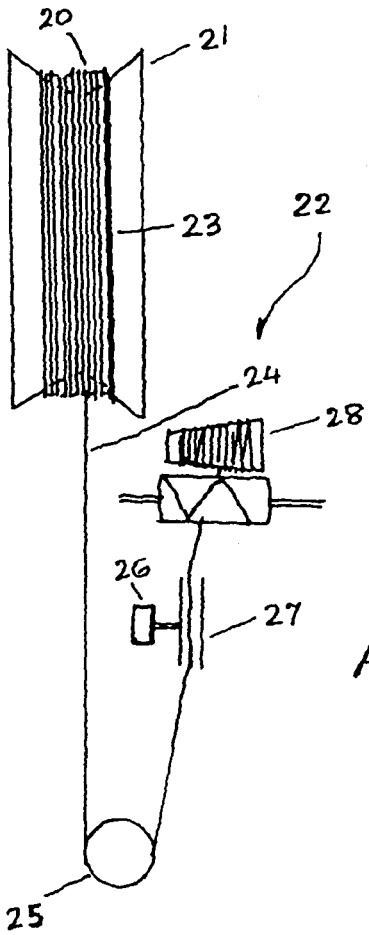
FIG. 3 shows the hank to cone winder.

Each hank 20 is mounted individually on individual hank holder 21 of hank to cone winding machine 22 and as illustrated in FIG. 3. The yarn hank 24 is converted into a cone of single yarn. For this purpose, the yarn 24 from holder 21 passes through a yarn guide pulley 25, a tension holding bracket 26 for holding a tensioner and gauge 27 and wound on a paper cone 28.

The invention claimed is:

1. A process for the preparation of indigo dyed yarn for use in the manufacture of knitted fabric by a knitting machine comprising the steps of:

i. forming a dyed rope of yarn by the step of indigo dyeing;

ii. individualizing the yarn of said dyed rope;

iii. forming separate packages of the yarn on separate spools of fixed ends, wherein each package of yarn formed on said spools contains equal numbers of ends of yarn;

iv. preparing individual hanks of each yarn end of each spool using a hank maker, wherein the number of hanks corresponds to the number of ends of yarn on each spool; and v. converting said hanks into individual cones of single yarn, wherein the number of cones corresponds to the number of ends of yarn individualized from the dyed rope.

2. The process as claimed in claim 1 wherein the dyed rope is divided and wound on separate spools in a long chain beamer.

3. An apparatus for the preparation of indigo dyed yarn for use in the manufacture of knitted fabric comprising a long chain beamer having a plurality of individual spools for receiving yarn having equal number of ends, a hank maker for producing individual hanks, wherein the number of hanks produced corresponds to the number of ends of yarn on each spool, wherein the number of cones corresponds to the number of ends of yarn individualized from the dyed rope.

4. The apparatus as claimed in claim 3 wherein said long chain beamer has a separator so as to separate the dyed yarn ends and wind them on to respective spools.

5. The apparatus as claimed in claim 4 wherein said hank maker comprises a tripod for receiving the spool mounted on a rotatable shaft and a heald for receiving the yarn from said spool.

6. The process as claimed in claim 1 further including the step of stopping the unwinding of said hanks in the event of a missing or broken yarn end.

7. The apparatus as claimed in claim 3 further including a stop motion device to stop the hank maker in the event of a missing or broken yarn end.

8. An apparatus for the preparation of indigo dyed yarn for use in the manufacture of knitted fabric comprising a long chain beamer having a plurality of individual spools for receiving yarn having equal number of ends, a hank maker for producing individual hanks, a cone winder to wind the hanks onto cones, and a tensioner between the hanks and the cones to provide tension to the yarn ends, wherein said long chain beamer has a separator so as to separate the dyed yarn ends and wind them onto respective spools and wherein each spool is fed to a hank maker for producing hanks equal to the number of ends in the spool through stop motion and ends separating system for avoiding entanglement between ends and further avoiding missing ends in case of yarn breakage during hank making.

9. The apparatus as claimed in claim 8 wherein said hank maker is driven by an individual motor and receives material in the form of individual ends equal to number of ends in the spool mounted on a rotatable shaft on a tripod with frictional brake system to control the speed of the spool as per yard delivery from spool equal to the delivery of the yarn to hank maker.

10. The apparatus as claimed in claim 8 wherein said hank maker comprises a tripod for receiving the spool mounted on a rotatable shaft, a heald for separating the individual yarn delivered to hank maker to avoid entanglement with each other and further, there is an electric stop motion which stops the feed and delivery instantly in case there is a breakage of yard from the feed side, thus avoiding missing ends.

* * * * *

UNITED STATES PATENT AND TRADEMARK OFFICE

CERTIFICATE OF CORRECTION

PATENT NO. : 7,185,405 B2
APPLICATION NO. : 10/493924
DATED : March 6, 2007
INVENTOR(S) : Rastogi et al.

It is certified that error appears in the above-identified patent and that said Letters Patent is hereby corrected as shown below:

Column 4, Claim 9, Line 45, "as per yard" should read -- as per yarn --

Column 4, Claim 10, Line 54, "yard from the" should read -- yarn from the --

Signed and Sealed this

Seventh Day of August, 2007

JON W. DUDAS
*Director of the United States Patent and Trademark Office*